United States Patent [19]

Weigl et al.

[11] 4,095,814

[45] Jun. 20, 1978

[54] HEEL HOLDER

[75] Inventors: Erwin Weigl, Brunn a. Gebirge; Josef Svoboda, Schwechat, both of Austria

[73] Assignee: TMC Corporation, Baar, Switzerland

[21] Appl. No.: 724,175

[22] Filed: Sep. 17, 1976

[30] Foreign Application Priority Data

Sep. 24, 1975 Austria ..... 7327/75

[51] Int. Cl.[2] ..... A63C 9/08

[52] U.S. Cl. ..... 280/618

[58] Field of Search ..... 280/617, 618, 626, 623

[56] References Cited

U.S. PATENT DOCUMENTS

| | | | |
|---|---|---|---|
| 3,937,480 | 2/1976 | Korger | 280/618 |
| 3,950,003 | 4/1976 | Korger | 280/618 |

*Primary Examiner*—Robert R. Song

*Attorney, Agent, or Firm*—Blanchard, Flynn, Thiel, Boutell & Tanis

[57] ABSTRACT

A heel holder for a safety ski binding having a sole plate which is secured to the ski by a locking member which is movable against the force of a spring. The locking member engages a holding member and the sole plate is secured adjacent its frontmost end against a vertical movement relative to the ski. In addition, the sole plate is pivotal approximately in the center thereof about a vertical axis which is fixed relative to the ski. The locking member engages a flange which cooperates with a locking element in overlapping relationship with the holder. The holder is supported for movement about a universal type joint.

10 Claims, 7 Drawing Figures

HEEL HOLDER

FIELD OF THE INVENTION

The invention relates to a heel holder for a safety ski binding having a sole plate held by a locking member movable against the force of a spring, which locking member engages a holding member secured to the ski and the sole plate is secured in its front area against a lifting off from the ski and is pivotally supported approximately in the center area about a ski-fixed journal or can be removed from the ski as in U.S. Pat. No. 4,033,603.

BACKGROUND OF THE INVENTION

A ski binding of the abovementioned type is for example described in German OS No. 2,221,105. In this known device the locking members act against a release to the side either only in front or only in the rear, a release upwardly, however, both in front and also in the rear. A release of the boot occurs, however, only after the sole plate has separated completely from the ski and the ski boot and sole plate are released together by the ski. This mode of operation has the disadvantage that the sole plate has to travel through a relatively large zone until it is released by the locking members and separated from the ski. The times delays which occur in this large zone can possibly have negative effects on safety in particular at very high travelling speeds because a delay of the release mechanism can occur. Therefore, in the known ski binding, the initial stress of the springs which cause the release is adjusted carefully to these circumstances. The increased spring adjustment or increased initial stress of the springs would still lie in the elastic zone of the binding.

An improved heel holder for a ski binding of the abovementioned type is described in U.S. Pat. No. 4,033,603. In this construction, the locking member is mounted on the sole plate and the holding member is mounted on the ski and the heel holder can be moved with respect to the sole plate. The heel holder is held in the downhill position by a control member associated with the locking member, which control member after a pivotal movement of the rear end of the sole plate a certain number of degrees release the heel holder to effect a release of the ski boot and subsequently, under the action of the spring loading, the locking member swings the sole plate back about the pivot bearing into its initial position and holds it on the ski.

The just now described construction has the disadvantage that the heel holder always opens up upwardly, regardless of whether the outside forces which act onto the sole plate cause a release upwardly, to the side or diagonally. This has the disadvantage that the forces which are not aligned in the direction of the direct release suffer a loss in form of additional friction and only the associated vector of the parallelogram of forces is important therein. Another disadvantage of the known construction is that a later and separate adjustment of the actual heel holder to the boot is not possible, because the heel holder and the locking member are fixedly related to one another.

The purpose of the invention is now to overcome the mentioned disadvantages and to construct a heel holder of the abovementioned safety ski binding type in such a manner that, between the heel holder and the inserted ski boot, a separate and possibly adjustable thrust adjustment is provided.

The set purpose is inventively attained by the locking member engaging a locking element of the holder through a flange and the heel holder is supported on an axis which extends transversely to the longitudinal direction of the ski, which axis in turn is held gimballike on the locking member.

With the inventive construction, all goals are clearly reached. The forces which act onto the heel holder are transferred by the locking member directly onto the heel holder, because same also carries out all movements of the sole plate. If the heel holder is opened during a fall, then the boot is released without regard to how the front holding part is designed. A simple suspension device is therefore also sufficient which holds the boot in the position of use.

A particularly preferable embodiment of the invention includes a flange engaging the heel holder through a screw connection which can be adjusted in the longitudinal direction of the ski. The elasticity of the ski binding can be regulated in this manner. By adjusting the screw, the amount of overlap of the locking element and holder part is determined, so that a smaller or a larger movement of the locking member results in the release.

According to a further thought of the invention, a spring is arranged between the locking element and the flange, which spring is substantially weaker compared with the spring which causes the release and serves only for holding the locking element in the respective position. This construction permits, during an arbitrary release, an overcoming of only this weaker spring force without requiring the main spring to be operated.

BRIEF DESCRIPTION OF THE DRAWINGS

Further advantages and details of the invention will now be discussed more in detail with reference to the drawings, which illustrate one exemplary embodiment.

In the drawings.

DETAILED DESCRIPTION

Figure 1:
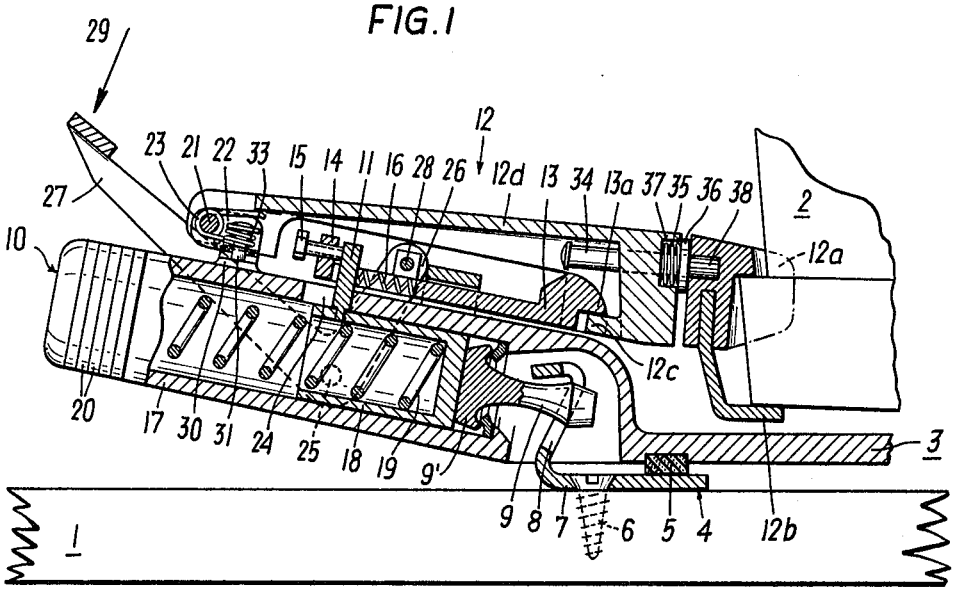
FIG. 1 is a longitudinal cross-sectional view of an inventive heel holder.
Figure 2:
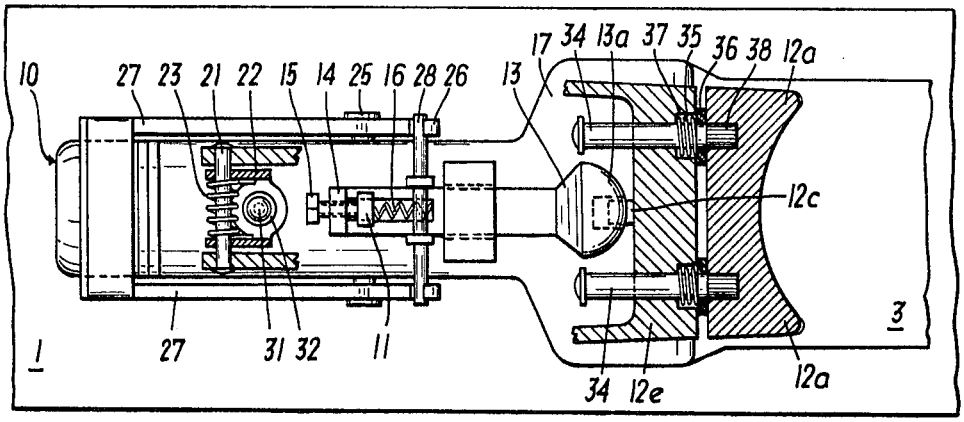
FIG. 2 is a top view of FIG. 1.

As can be taken from FIGS. 1 and 2, a sole plate 3 which is equipped with a locking member 10 is arranged on a ski identified by reference numeral 1. The sole plate 3 engages, in the illustrated rear area of the ski binding, a base plate 4 and a friction-reducing element 5 is inserted between the base plate 4 and the sole plate 3. The base plate 4 is secured to the ski by means of screws 6 and has a rearwardly extending holding part 7 having an opening 8 therethrough receiving the stem of a mushroom-shaped thrust element 9. The mushroom-shaped thrust element 9 lies with its enlarged head 9' on the front wall of a reciprocal piston 18, which is loaded by a spring 19. The thrust element 9 and the reciprocal piston 18 with the spring 19 are positioned in a housing 17 which is an integrally constructed part at the rear part of the sole plate 3. The initial stress of the spring 19 can be adjusted by using conventional insert rings 20.

The heel holder, which as a whole is identified by reference numeral 12, has a holding **12*a*** engaging the ski boot 2 and a step plate 12*b*. The heel holder 12 is constructed in its rear area approximately in the form of an elongated hollow rod 12*d* and is pivotally supported at its end remote from the holding part 12*a* for movement about an axle 21 which extends transversely to the longitudinal axle of the ski. The axis 21 is held in a bearing block 22 which is held by means of a gimballike mounting on the locking member 10, which mounting will be discussed later on. To ensure a release, the heel holder 12 is loaded by an operating lever spring 23.

The elongated hollow rod 12*d* of the holder 12 houses a reciprocal locking element 13 in its hollow part, the nose 13*a* of which locking element is gripped under by a part 12*c* of the holder 12. The longitudinal position of the locking element 13 can be adjusted by utilizing a flange 11 on the locking member 10. The flange 11 is secured to the piston 18 and projects through a recess 24 in the wall of the housing 17 of the locking member 10 into the path of the locking element 13. The flange 11 is positioned adjacent the free end of a screw 15 which can be adjusted in a mounting part 14 on the locking element 13. The mounting 14 is constructed on or is rather located adjacent the rear part of the locking element 13, so that an adjustment of the piston 18 against the force of the spring 19 causes at the same time an adjustment of the locking element 13. The screw 15 is maintained in engagement with the flange 11 by a spring 16 engaging and extending between the opposite side of the flange 11 and the locking element 13. As long as the nose 13*a* of the locking element 13 overlaps the part 12*c* of the holder 12, the holder 12 can be swung neither upwardly nor laterally. As soon as the part 12*c* is released by the nose 13*a* of the locking element 13, the holder 12 is under the effect of the forces applied by the ski boot 2 and the ski boot 2 is released.

For an arbitrary release, a manually operable lever 27 is provided and is arranged for pivotal movement about an axis 25 which extends transversely to the longitudinal axis of the ski. The lever 27 has an arm 26 which engages a transversely extending pin 28 connected to the locking element 13 through the weak spring 16. A pressure applied in direction of the arrow 29 (FIG. 1) onto the release lever 27 during an arbitrary release causes the release lever to compress the weak spring 16 and to then also take along therewith the locking element 13. Thus, the overlapped locking between the nose 13*a* of the locking element 13 and the part 12*c* of the holder 12 is terminated without operation or movement of the flange 11 and thus without operation of the release spring 19. Thus, relatively small forces are sufficient to permit a release of the ski boot 2 from the binding.

The construction of the nose 13*a* of the locking element 13 is adjusted relative to the part 12*c* of the holder 12 so that the release forces remain substantially constant in every direction. A circular sectional shape has proven to be the preferable shape.

Figure 5:
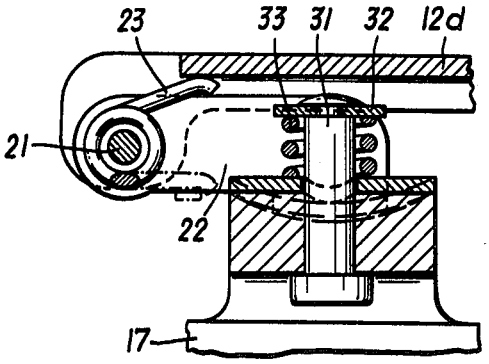
FIGS. 5 to 7 illustrates in an enlarged scale the gimballike suspension in associated views.
Figure 6:
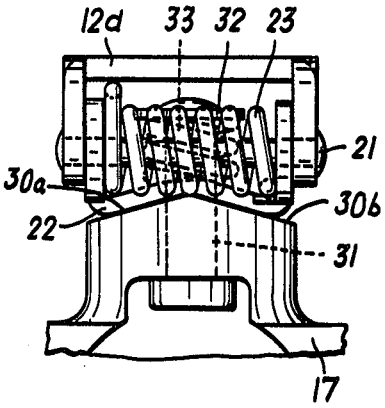
Figure 7:
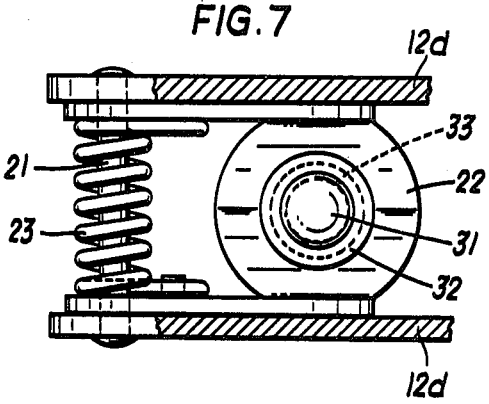

The structure of the gimballike mounting is as described below embodied in the present example. A seat 30, which is made preferably of the material of the housing 17, is provided in the upper rear area of the housing 17. The seat 30 has upwardly facing inclined surfaces 30*a* and 30*b* defining an inverted V-shape on its upper end (See FIGS. 5 and 6) and has an opening therein for receiving a locking bolt 31 around which is supported a spring 33 positioned between a spring plate 32 and the upper surfaces of a portion of the bearing block 22 resting on the upper surface of the seat 30. The spring 33 extends concentrically to the locking bolt 31 and continuously presses the bearing block 22 on to the seat 30. In this manner, it is assured that the heel holder 12 can be laterally pivoted about the vertical axis of the locking bolt 31, however, the just described bearing 22, seat 30 assures a certain resistance to lateral movement, so that the heel holder 12 is still resiliently supported securely on the seat 30 for pivotal movement about the horizontal axis of the axle 21. The heel holder 12 is supported about the axle 21 for vertical pivotal movement, which axle 21 is held by the bearing block 22 and is concentrically surrounded by the operating lever spring 23 (See FIGS. 5 and 7). The operating lever spring 23 loads the rod 12*d* of the heel holder 12.

Figure 3:
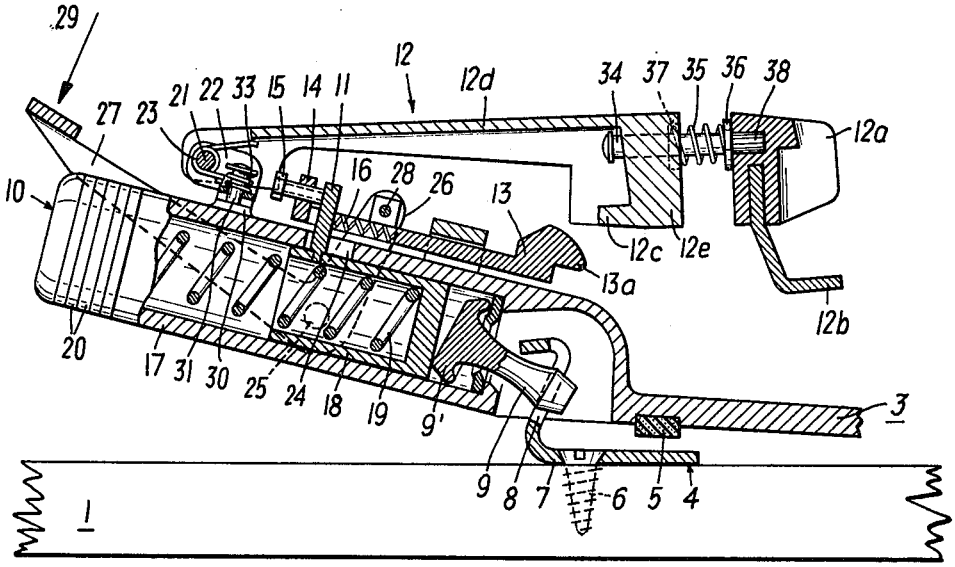
FIG. 3 illustrates the heel holder in upwardly open condition, otherwise like in FIG. 1.
Figure 4:
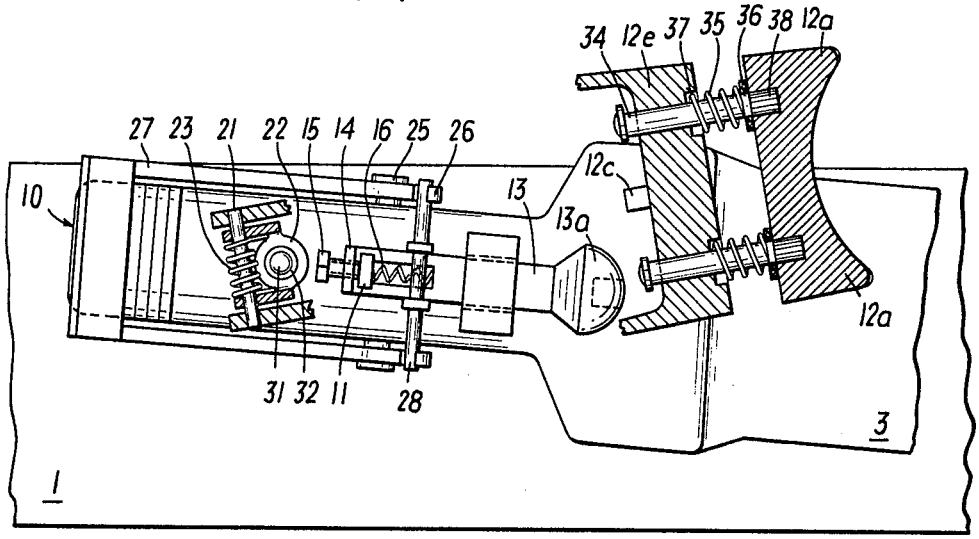
FIG. 4 is a top view of the heel holder after a lateral release.

The holding part 12*a* is connected to a web part 12*e* of the rod 12*d* through a pair of retainer pins 34 each of which is surrounded by a helical spring 35. An antivibration or vibration absorbing member 36 is arranged on the front side of the web 12*e*. The helical spring 35 is positioned in a recess 37 in the web 12*e*. The holding part 12*a* has also a recess 38 to receive by means of a press fit the scored end of the retainer pins 34. Through this development of the front area of the heel holder 12, a stepping into the binding is assured even when the front part of the ski boot for example cooperates with a fixedly arranged holding device, for example with metal loop. During stepping in, the heel of the ski boot 2 presses the holding part 12*a* against the force of the helical springs 35 in direction of the rod 12*d* of the heel holder 12, so that the ski boot can be received by the binding parts. This position is shown in FIGS. 1 and 2. However, if the heel holder is released, as is shown in FIGS. 3 and 4, the helical springs 35 function and the holding part 12*a* moves away from the web 12*e* of the rod 12*d* of the heel holder 12. This built-in elasticity assures therefore an easy stepping in, however, the ski boot lies securely in the binding after locking and an unlocking can take place only automatically through a compression of the spring 19 or by an arbitrary operation of the lever 27.

If excessive vertical forces occur which would cause a swinging of the heel holder 12 upwardly, then these forces first cause a certain lifting of the plate 3 from the ski surface and the mushroom-shaped thrust element 9 will be shifted in the recess 8 of the holder 7. The enlarged head 9′ of the mushroom-shaped thrust element 9 will effect a movement of the piston 18 against the force of the spring and cause the flange 11 to move the screw 15 and the mounting 14 and thus the locking element 13 away from the part 12*c* of the heel holder 12. As soon as the nose 13*a* of the locking element 13 releases its engagement from the part 12*c*, the heel holder 12 is pivoted by the spring force of the operating lever spring 23 and the ski boot 2 is released. The released position is illustrated in FIG. 3 and a comparison of FIG. 1 and FIG. 3 will facilitate a recognition of the just described operation. If lateral forces occur, then the mushroom-shaped thrust element 9 is laterally shifted within the recess 8 of the holding part 7 and the front surface of the enlarged head 9′ causes an adjustment or compression of the spring 19. The boot is released in a similar manner as during a release upwardly.

The just described operation indicates at the same time the advantages of the inventive heel holder. The great advantage lies in the ski boot being released in each case from the binding independent of the direction of the created forces, even if the front bolding part consists only of a wire rod. A further important advantage is that a release function either upwardly or laterally takes place under different speed ratios, because the mushroom-shaped thrust element 9 is supported in one case on the holding part 7 and in the other case on the side of the recess 8. Through this, as can particularly also be recognized from FIG. 3, speed ratios of approximately 1 : 2 are achieved. Further ratios exist in the various fulcrums for the vertical and horizontal movements.

The invention is not limited to the illustrated exemplary embodiment. Various changes can be made without departing from the scope of the invention. For example, it is also possible to fix the connection between the flange 11 and the mounting 14, of course the advantages which exist through the use of an adjusting screw are then lost. A different modification consists in the possibility of providing in place of the insert rings 20 a spring plate to support the spring 19, which then cooperates with a spring which is adjustable in a sleeve, through which the initial stress of the spring 19 can also be regulated.

A further modification can be provided for the mounting of the holding part 12*a* on the rod 12*d*, for example, by making the holding part tiltable and/or guided slidably on a sloped surface and being fixed in the engaging or holding position by a guide surface in the position illustrated in FIG. 1.

Also the gimballike or universal joint suspension of the heel holder 12 can be constructed, for example, so that the axes which permit the horizontal and vertical pivoting movement are housed in one unit and the inclined surfaces will lie preferably symmetrically downwardly.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a heel holding device for a safety ski binding having a heel holder and support means for pivotally securing said heel holder to a sole plate adjacent the rear end thereof, a holding member mounted on a ski, said sole plate being held in a boot holding position by a locking member supported for movement against the force of a spring, said locking member being mounted on the rear end portion of said sole plate and releasably engaging said holding member, said sole plate being secured adjacent its front end against a lifting off from said ski and being movable relative to said ski between said boot holding position and a boot releasing position, the improvement comprising a locking element movable into and out of locking engagement with said heel holder to hold, when in said locking engagement, a heel of a ski boot to said sole plate, connecting means for connecting said locking member to said locking element so that a movement of said locking member in response to a separating force between said ski and said ski boot will effect a movement of said locking element toward said out of locking engagement position with said heel holder and wherein said support means supports said heel holder for movement about mutually perpendicular axes extending transversely to the longitudinal axis of the ski.

2. The improved heel holding device according to claim 1, wherein said connecting means comprises a flange;

wherein said heel holding device includes a housing and a piston reciprocally movable in said housing, said housing being mounted on said sole plate adjacent the rear end thereof, said piston being loaded by a spring, said flange being connected to said piston and extending through a recess in said housing and engaging on one side thereof said housing and on the other side thereof a screw threadedly engaged with said locking element and which can be adjusted in longitudinal direction of the ski to effect a control of the initial position of said locking element relative to said heel holder.

3. The improved heel holding device according to claim 2, including a second spring arranged between said locking element and said one side of said flange, which spring is substantially weaker compared with the first mentioned spring which causes a release of said ski binding, said second spring being used only to hold said locking element and said screw in the respective position against said flange.

4. The improved heel holding device according to claim 1, wherein said locking element has a nose and wherein said heel holder has a projection which projects under said locking element in said locking engagement position.

5. The improved heel holding device according to claim 1, wherein said support means comprises a bearing block pivotally supporting said heel holder for movement about a horizontal axis, said bearing block being supported on a seat and for movement about a vertical pivot axis.

6. The improved heel holding device according to claim 5, wherein at least one of said heel holder and said bearing block include return means for effecting a return of said heel holder to an original position thereof.

7. The improved heel holding device according to claim 6, wherein said return means includes a spring for returning said heel holder about said horizontal axis to an original position thereof.

8. The improved heel holding device according to claim 6, wherein said heel holder includes a housing for housing said return means; and wherein said return means includes a spring for effecting a return of said bearing block about said vertical axis to an original position thereof, said bearing block having inclined surface means thereon aligned with inclined surface means on said housing.

9. The improved heel holding device according to claim 1, wherein said heel holder includes a housing having a web portion, said housing having said locking element mounted thereon, a holding part and second support means for supporting said holding part for movement in the longitudinal direction relative to said web portion.

10. The improved heel holding device according to claim 9, wherein said second support means includes at least one retainer pin reciprocally supported on said web portion, a further spring for urging said holding part away from said web portion, and an antivibrator device mounted between said holding part and said web portion to provide an elastic support of said holding part against said web portion when said ski boot is in said ski binding and said second spring is compressed.

* * * * *